US005407089A

United States Patent [19]

Bird et al.

[11] Patent Number: 5,407,089

[45] Date of Patent: Apr. 18, 1995

[54] STORAGE CONTAINER LID SCOOP

[75] Inventors: David A. Bird; Mitchell L. Wilgus, both of Akron, Ohio

[73] Assignee: Rubbermaid Incorporated, Wooster, Ohio

[21] Appl. No.: 180,826

[22] Filed: Jan. 13, 1994

[51] Int. Cl.[6] ..... B65D 43/02

[52] U.S. Cl. ..... 220/212.5

[58] Field of Search ..... 220/212, 212.5, 282, 220/337, 908; 15/257.1, 257.6

[56] References Cited

U.S. PATENT DOCUMENTS

| | | | |
|---|---|---|---|
| D. 217,498 | 5/1970 | Dilyard | D49/35 |
| D. 246,566 | 12/1977 | Skiver | D7/194 |
| D. 281,111 | 10/1985 | McClelland | D34/8 |
| D. 293,843 | 1/1988 | Kroll et al. | D34/8 |
| D. 297,875 | 9/1988 | Carville | D34/11 |
| D. 308,273 | 5/1990 | Hanna | D34/11 |
| D. 321,576 | 11/1991 | Hradisky | D34/8 |
| D. 322,350 | 12/1991 | Craft et al. | D34/9 |
| D. 326,343 | 5/1992 | Hradisky | D34/7 |
| D. 326,754 | 6/1992 | Hradisky | D34/7 |
| D. 335,562 | 5/1993 | Evans | D34/7 |
| 1,908,730 | 5/1933 | Caldwell et al. . | |
| 2,549,572 | 4/1951 | Campanelli | 220/212 |
| 3,083,859 | 4/1963 | Gardiner | 220/30 |
| 3,156,941 | 11/1964 | Tomaiuolo | 220/212 X |
| 3,390,804 | 7/1968 | Morgan | 220/212 |
| 4,600,113 | 7/1986 | DeMars | 220/212 X |
| 4,649,813 | 3/1987 | Kehl | 220/337 X |
| 4,776,478 | 10/1988 | Miller et al. | 220/337 X |
| 4,907,710 | 3/1990 | Bulkens | 220/212 X |
| 5,172,823 | 12/1992 | Moetteli | 220/334 |

FOREIGN PATENT DOCUMENTS

| | | | |
|---|---|---|---|
| 2252965 | 6/1975 | France | 220/212 |
| 2190279 | 11/1987 | United Kingdom | 220/212 |

OTHER PUBLICATIONS

Catalog page, Trash containers; Tucker Housewares, 25 Tucker Drive, Leominster, Mass. 01469. Publication date Jan. 1983.

Page 16, Refuse containers; Rubbermaid Commercial Products Inc., 3124 Valley Avenue, Winchester, Va. 22601. Publication date 1992.

*Primary Examiner*—Allan N. Shoap

*Assistant Examiner*—Vanessa Caretto

*Attorney, Agent, or Firm*—Richard B. O'Planick; Lisa B. Riedesel

[57] ABSTRACT

A storage container assembly is disclosed comprising a lid (12) and a base container (13). The lid body has a scoop recess (26) foraged in a forward end for collecting articles, and a handle bar (32) extending from the recess to a rearward end wall (24) of the lid. The handle bar has a hand opening (34) therebeneath, and is positioned on the longitudinal center axis of the lid. The lid pivots about horizontal pivot pins (42) to selectively enclose and uncover the top opening (50) of the container, and the lid is detachable from the container upper rim by the handle bar, whereby enabling a user to collect refuse into the scoop recess.

17 Claims, 3 Drawing Sheets

STORAGE CONTAINER LID SCOOP

BACKGROUND OF THE INVENTION

1. Field of the Invention

The invention relates generally to lidded storage containers, and more particularly to a pivotal lid for a storage container having dual utility as a collection scoop.

2. The Prior Art

Waste containers having pivotal lids are well known consumer items. The lid component is typically provided with a molded plastic body, having molded pivot posts at each side which fit downwardly into pivot sockets of the container. The lid pivots about a horizontal axis, with a forward portion of the lid entering the container, whereby exposing a top opening of the container so that articles can be deposited inside.

The use of such a container finds applications in storing refuse, but can also be used for storing articles such as toys or household items. When used in the collection of refuse, a user would typically use a broom and dustpan to collect dirt and debris, and then deposit the contents of the dustpan into the container by pivoting the lid downward. However, dustpans in consumer use often have a width which exceeds the opening created by the waste container when the lid is pivoted inside, making the emptying of the dustpan problematic. Also, by having to pivot the lid downward with one hand, and empty the dustpan with the other, a two-handed procedure, it is not uncommon for spillage to occur. Finally, locating a dustpan for use in collecting debris is often inconvenient since the storage of a dustpan can be in a location remote from the refuse container.

SUMMARY OF THE INVENTION

The present invention overcomes the problems summarized above in the operation of available refuse collection systems. A container and lid assembly is provided with the lid component having a dual function. The lid has a body which is mounted to the upper rim of the container by means of sideward extending pivot pins which fit downward into associate sockets in the container rim. The lid body has a scoop recess formed in a forward end for collecting refuse and a handle gripping portion at a rearward end. The lid body is detachable from the container by a user grasping the handle and lifting upward in single handed fashion, whereby exposing the entire upper opening of the container. The lid body may then be used as a dustpan, or scoop, for collecting debris or small articles. The contents of the lid body may be deposited into the entirely exposed upper opening of the container in single-handed fashion. Thereafter, the lid may be returned to the top of the container in single handed fashion, where it can serve as a pivot top to the container.

Accordingly, it is an objective of the present invention to provide a storage container having a pivot top lid which serves a dual function.

A further objective is to provide a scoop which can serve dually as a storage container lid.

Yet a further objective is to provide a storage container lid which can be removed and returned to the top of a container body in single handed fashion.

Another objective is to provide a storage container lid which can empty debris into a storage container body in single handed fashion.

Still another objective is to provide a storage container lid which can be removed from a container body, exposing the entire upper opening of the container for receipt of debris.

A further objective is to provide a storage container lid having dual modes of operation, and which can be economically and readily manufactured and used.

These, and other objectives, which will be apparent to those skilled in the art, are achieved by a preferred embodiment which is described in detail below, and which is illustrated by the accompanying drawings.

DESCRIPTION OF THE PREFERRED EMBODIMENT

Figure 1:
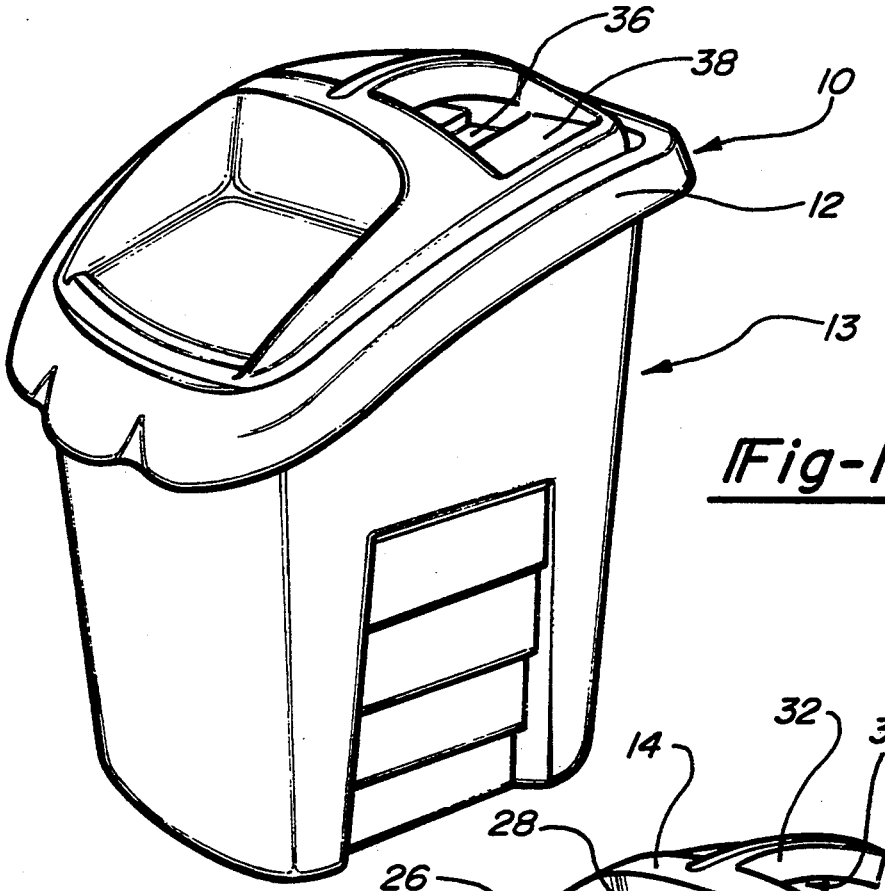
FIG. 1 is a from perspective view of the subject lid and container assembly, shown in the assembled condition.
Figure 2:
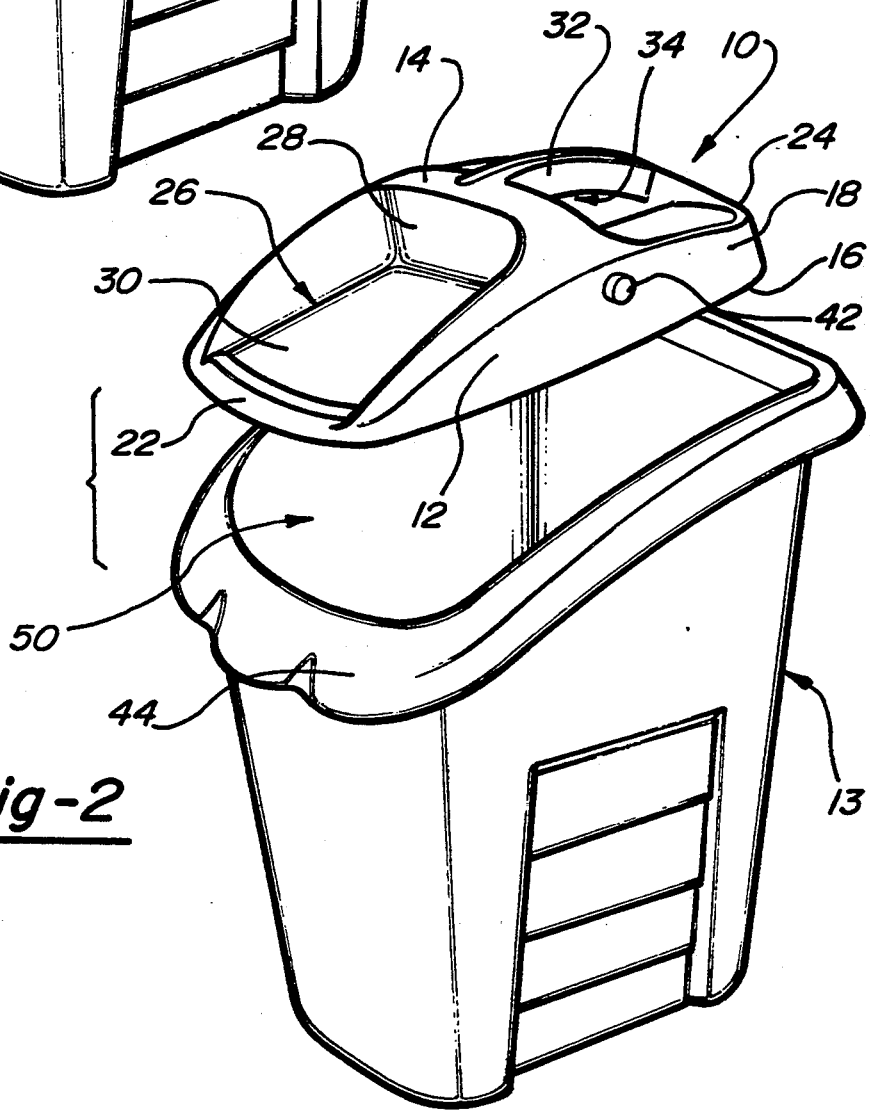
FIG. 2 is an exploded front perspective view of the lid and container assembly.

Referring first to FIGS. 1 and 2, it will be seen that the subject storage container 10 comprises a lid 12 and a base container 13. Each component can be molded by conventional means from commercially available plastic. For example, the lid can be made of polypropylene or high density polyethylene, and the base can be made of high or low density polyethylene. The preferred method of manufacture is by injection molding.

The lid is configured as a rectangular body, having a top surface 14, a bottom surface 16, sidewalls 18, 20, a forward end wall 22, and a rearward end wall 24. A dished out, scoop shaped recess 26 is formed at a forward end, extending downward into the top surface 14, and defined by radiussed internal sidewalls 28 and a bottom floor surface 30. The scoop recess 26 extends from the midpoint of the lid 12 to the forward end wall 22, and opens upwardly and forwardly. The forward end wall 22 is of a relatively lower height than the sidewalls 18, 20 for a purpose which will be apparent from the following.

Figure 3:
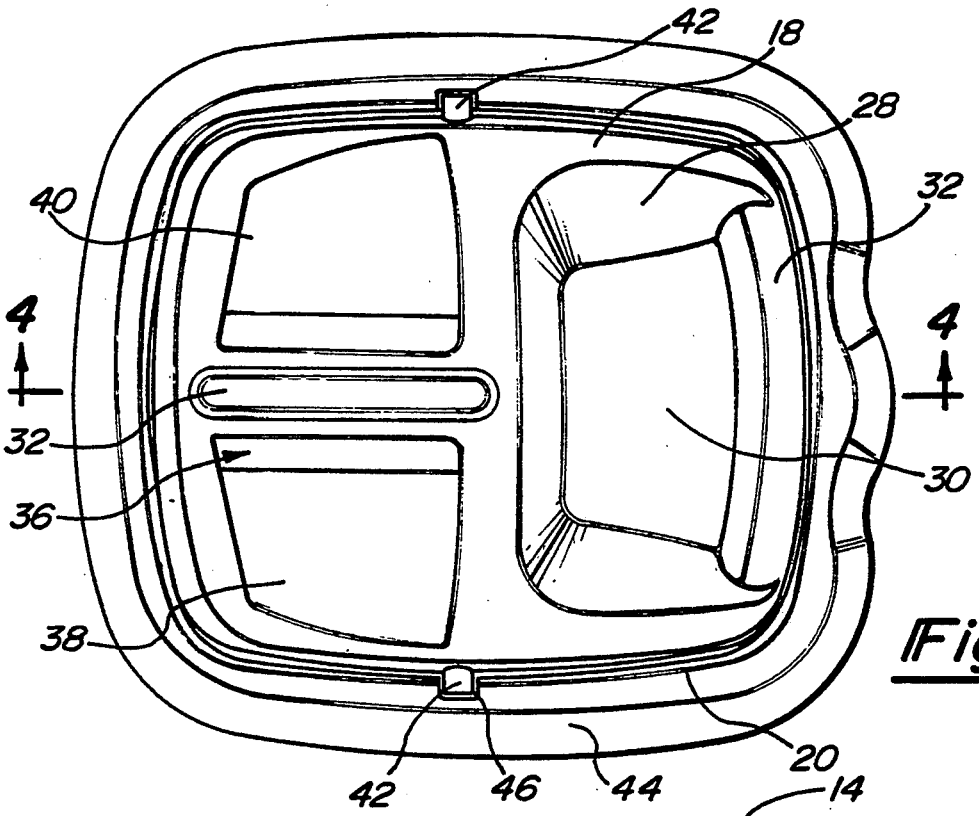
FIG. 3 is a top plan view of the assembled lid and container base.
Figure 4:
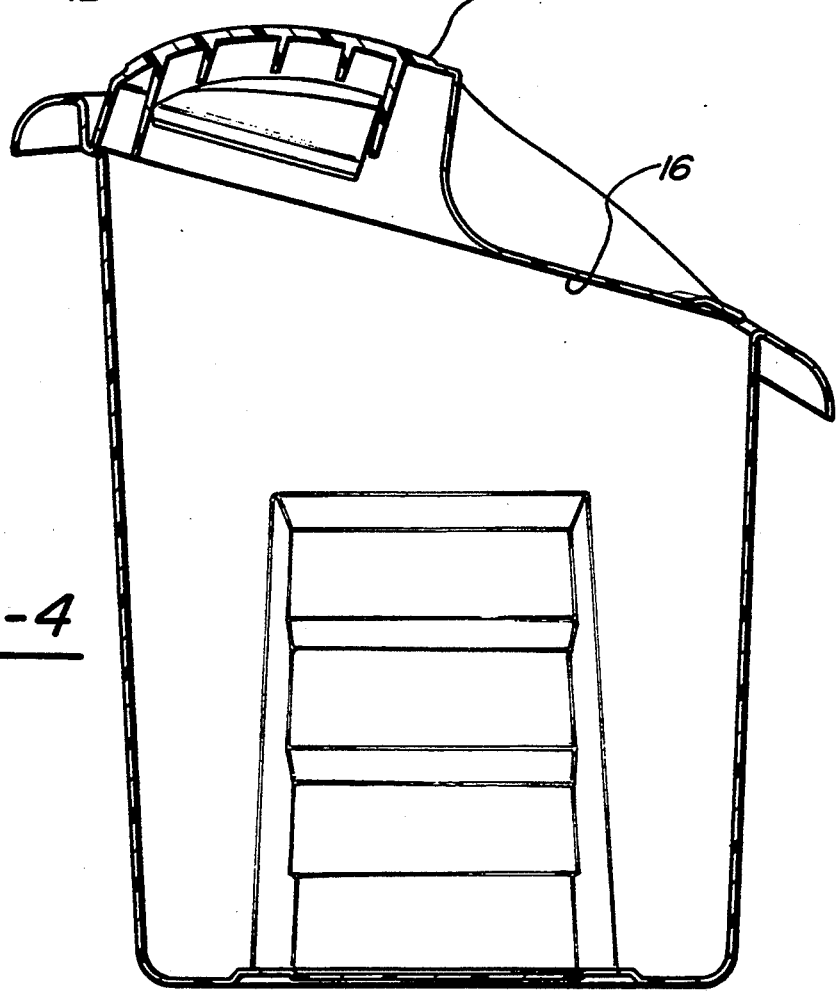
FIG. 4 is a vertical section view of the assembled lid and container base, taken along the line 4—4 of FIG. 3.
Figure 5:
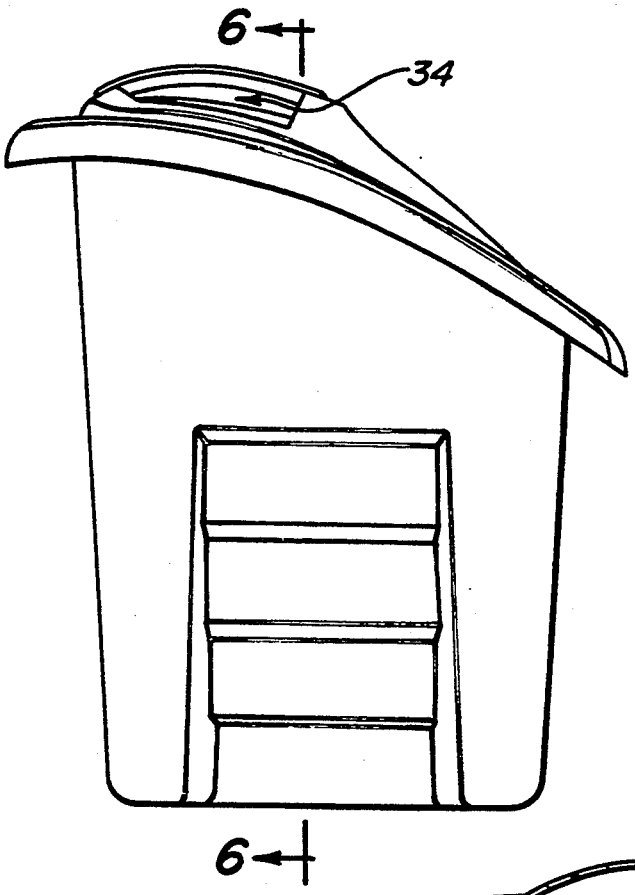
FIG. 5 is a side elevation view of the assembled lid and container base.

With reference to FIGS. 1, 2, and 3, a handle bar 32, of elongate and cylindrical proporation, extends along the top surface 14 of the lid, positioned along the center longitudinal lid axis. The forward end of the handle bar 32 is positioned adjacent the rearward end of the scoop recess 26, and a rearward handle end is adjacent the rearward endwall 24. A grip opening 34 is provided beneath the handle bar 32 to enable a user to grasp the bar in single handed fashion, with the user's fingers encircling the bar and residing in the opening 34.

A through channel 36 is formed to extend through the lid bottom surface 16 to the handle bar opening 34. Channel sides 38, 40 define the channel 36 and are molded to slope downward and inward toward the handle bar 32. The lid body is further provided with integrally molded pivot pins 42 which extend horizontally outward from the sidewalls 18, 20, positioned at the midsection of the lid.

Figure 6:
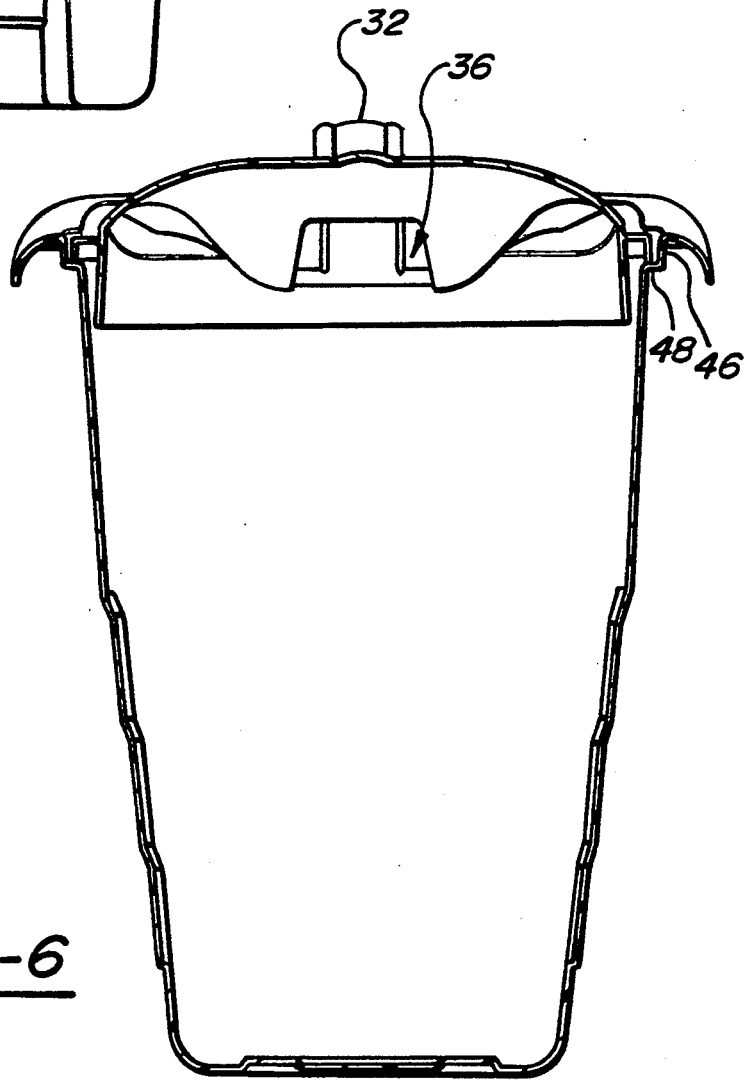
FIG. 6 is a transverse vertical section view of the assembled lid and container base, taken along the line 6—6 of FIG. 5.

The container base 13 is of rectangular configuration, terminating at an upper downturned rim flange 44. The container has two sockets 46 (FIGS. 3 and 6) formed within inner sidewalls, the sockets being open at the top and terminating at a bottom socket floor 48. It will be appreciated that the sockets 46 are located and dimensioned to receive downwardly the pivot pins 42 of the lid 12 and that, thereupon, the pivot pins 42 are supported by the socket surface 48.

FIG. 1 shows the lid component assembled to the base container. In this position, the lid is free to pivot about the pivot pins 42 whereupon the forward scoop recess 26 extends downward into the container top opening 50, exposing a forward portion of opening 50 so that debris or articles may be inserted past the lid and into the container. The lid is weight distributed relative to the pins 42 such that, upon releasing the lid, the lid will return to the position depicted in FIG. 1. The lid 12 thus covers the container opening 50 in normal use, yet can be pivotted to by the user to deposit debris into the container.

FIG. 2 shows the lid removed from the base container, as a user would do to use the lid in its second functional mode. A user can grasp handle bar 32 and lift the lid 12 off the container rim, as pivot pins 42 depart upwardly from sockets 46. The lid now functions as a scoop or dustpan, and can be used to collect debris or loose articles in the scoop recess 26. The height of the forward lid endwall 22 is low to enable the user to sweep loose articles into the recess 26.

When the recess 26 is prepared for deposit, the user may carry the lid 12 in single handed fashion back to container 13. Because the lid has been removed, the entire upper opening 50 of the container is exposed to allow the user to deposit the contents of the scoop recess 26 into the container without spillage. In fact, the scoop may be oriented to extend along the longitudinal sidewalls the container to make the transfer of the scoop recess contents spill-free.

Thereafter, the lid can be returned to the top of the container 13 in single handed fashion by lowering the lid until the pivot posts 42 enter the sockets 46. So postitioned, the lid resumes its function as a pivotting container cover.

From the foregoing it will be appreciated that the subject container lid is of unitary construction, readily moldable, and economic to manufacture. The position and configuration of the handle relative to the lid body makes the lid capable of single handed use as a debris scoop or as a pivotting lid. The handle extends from the rearward end surface to the middle of the lid, enabling the user to lift the scoop substantially over center. The forward and rearward weight of the lid is accordingly balanced below the handle, making a single-handed lifting of the lid convenient and comfortable.

Moreover, the flat bottom surface 16 of the lid at the forward end makes it lie flat so as to better collect floor sweepings, and the deep scoop recess 26 can hold a substantial volume of articles or debris.

The subject container can function as a refuse container, and the lid used as a dustpan. Alternatively, the container can function as a storage container, such as for small toys, and the scoop lid used to collect the toys for return into the container.

While the above sets forth the preferred embodiment of the invention, the invention is not to be so restricted. Other embodiments, which will be apparent to those skilled in the art and which use the teachings herein set forth, are intended to be with the scope and spirit of the present invention.

We claim:

1. A storage container lid, comprising:

a lid body removably positionable upon an upper rim of a storage container and enclosing a forward portion of an upwardly opening internal storage chamber of the storage container, and the lid body having an upwardly opening scoop recess at a forward end of the lid body, defined by spaced apart sidewalls, a bottom floor surface, and a rearward end wall located substantially midway between the forward end and a rearward end of the lid body, and the scoop recess having an open forward end and an open top for receiving refuse into the scoop recess, and the lid body having an elongate handle bar positioned to extend between the scoop recess and the rearward end of the lid body, above and inward of the upper rim of the container.

2. A lid according to claim 1, wherein the lid body having pivotal attachment means for pivotally mounting the lid body to the container upper rim, the lid body pivoting about a horizontal axis to pivot the scoop recess downward and selectively expose the container storage chamber.

3. A lid according to claim 2, wherein the pivotal attachment means comprising horizontally extending first and second pivot pins, each extending outward from a respective side of the lid body and residing within first and second sockets in the container upper rim.

4. A lid according to claim 3, wherein the lid body scooping recess pivoting downward into the container storage chamber.

5. A lid according to claim 4, wherein the container sockets opening upward and the lid body pivot pins having a dimension and position to drop downward into the container sockets.

6. A lid according to claim 1, wherein the lid body having a top, bottom, forward, and rearward surfaces and two sidewalls extending between the forward and rearward surfaces, and the scoop recess is formed within the top lid body surface and extends forward to the lid body forward surface.

7. A lid according to claim 6, wherein the lid body forward surface having a relatively low height.

8. A lid according to claim 7, wherein the handle bar comprising a hand grip member extending backward toward the rearward lid body surface, and a hand opening positioned below the hand grip member to facilitate a digital grasping of the hand grip member by a user.

9. A lid according to claim 8, wherein the hand grip member extending along a longitudinal central axis of the lid body.

10. A waste receptacle lid comprising:

a lid body removeably positionable upon an upper rim of a storage container and enclosing a forward portion of an upwardly opening internal storage chamber of the storage container, and the lid body having an upwardly opening scoop recess formed in a forward end of the lid body for collecting refuse, the scoop recess being defined by spaced apart sidewalls, a bottom floor surface, and a rearward end wall positioned to transversely extend across the lid body substantially midway between the forward end and a rearward end of the lid body, and an elongate handle bar extending rearward from the scoop recess to the rearward end of the lid body, the handle bar having a location above a rearward portion of the storage container internal storage chamber and within the upper rim of the container, and the lid body being detachable from the container upper rim by the handle bar.

11. A lid according to claim 10, wherein the lid body having pivotal attachment means for pivotally mounting the lid body to the container upper rim, the lid body pivoting about a horizontal axis to selectively uncover a portion of the container storage chamber.

12. A lid according to claim 11, wherein the pivotal attachment means comprising horizontally extending first and second pivot pins, each extending outward from a respective side of (he lid body and residing within first and second sockets in the container upper rim.

13. A lid according to claim 12, wherein the lid body scoop recess pivots downward into the container storage chamber, whereby depositing its contents into the chamber.

14. A lid according to claim 13, wherein the container sockets open upward and the lid body pivot pins having a dimension and position to drop downward into the container sockets.

15. A lid according to claim 10, wherein the scoop recess communicates with a forward wall of the lid body, and the forward wall has a relatively low height.

16. A lid according to claim 15, wherein the lid body further comprising a hand opening positioned below the handle bar to facilitate a manual grasping of the handle bar by a user, and a through-channel extending through the lid body from the rearward portion of the storage container internal storage chamber to the lid body hand opening.

17. A lid according to claim 16, wherein the handle bar extends along a longitudinal central axis of the lid body.

* * * * *